United States Patent [19]

Forte et al.

[11] 4,180,988

[45] Jan. 1, 1980

[54] BI-DIRECTIONAL FILTER-DRIER FOR HEAT PUMPS

[76] Inventors: Jimmy L. Forte, 2815 Madison Ave., Granite City, Ill. 62040; Creo B. Lindsay, 1206 Grand Ave., Madison, Ill. 62060

[21] Appl. No.: 888,140

[22] Filed: Mar. 20, 1978

[51] Int. Cl.[2] ..... F25B 43/00

[52] U.S. Cl. ..... 62/474; 62/324

[58] Field of Search ..... 62/85, 324 R, 324 A, 62/474

[56] References Cited

U.S. PATENT DOCUMENTS 3,178,022 4/1965 Balogh ..... 62/474

*Primary Examiner*—Ronald C. Capossela

[57] ABSTRACT

A filter-drier for a heat pump system is installed in flow lines in which the flow of refrigerant is reversed when the system changes from the heating to the cooling mode. Two side-by-side filter-drier units, joined to the flow line by a pair of Y-connectors, are so installed with check valves at the inlet and outlet of each, to filter the refrigerant flowing in one direction through a low pressure filter-drier unit for the heating mode and to filter the high pressure refrigerant flowing in the other direction through the other unit, a more porous filter-drier, for the cooling mode. The outlet check valves permit refrigerant flow through only one filter, and the inlet check valves prevent entrainment, into the flow out of that filter, of contaminants previously trapped in the other filter.

8 Claims, 2 Drawing Figures

BI-DIRECTIONAL FILTER-DRIER FOR HEAT PUMPS

BACKGROUND OF THE INVENTION

The present invention relates to filter-driers for removing contaminants and moisture from refrigerant lines, and specifically relates to such filter-driers for use in heat pumps.

Using filtering materials such as screens, beads, fiberglass and granular desiccants, conventional filter-driers for refrigeration systems remove both contaminants and moisture from the refrigerant. These filter-driers are uni-directional; in filtering they merely block contaminants from further forward movement.

Heat pump systems have contaminant and moisture problems similar to conventional refrigeration systems. Since, for heat pump systems the refrigerant flow is reversed when the system changes from the heating to the cooling mode and the same refrigerant lines carry flow in either direction, a conventional uni-directional filter-drier would be ineffective. Conventional filter-drier units used for heat pumps have ordinarily been installed between the compressor and four-way valve of the system, since refrigerant flow therebetween is always in one direction.

Such placement of the filter requires installation within the heat pump cabinet, where the compressor and four-way valve are contained. Access is normally very difficult. Since the connections to the filter-drier units are made by silver soldering at about 1400° F., replacement of the filter within the cabinet is extremely difficult. In case of a burn-out of a compressor motor of the type cooled by the refrigerant, it is imperative that the filter be replaced, since burning of the motor in the presence of the fluorocarbon refrigerant contaminates the system with acidic products of reaction. Upon failure to replace the filter in such a situation, the acids will soon cause the heat pump system to fail. After a motor burn-out, it is good practice to replace the new filter after 24–48 hours of operation, but servicemen seldom do so because of the extreme difficulty of replacement.

Placement of a conventional uni-directional filter-drier in a refrigerant line in which the direction of refrigerant flow is reversed upon change from the heating to the cooling mode has not been successful. Even if the filter effectively filters refrigerants flowing in either direction, upon reversal of the direction of flow, contaminants which had been trapped behind the screens and in the filtering materials are likely to be flushed backward from the filter inlet into the heat pump system.

A bi-directional filter-drier utilizing a single filtering element is subject to certain operating problems. For winter operation in the heating mode, the pressure of the refrigerant in the liquid line is much lower than for summer operation in the cooling mode. Conventionally, filter-driers used for low pressure lines are more porous than those used for high pressure lines. Failing to use the proper filter for the lower pressure heating mode could cause an unacceptable pressure drop (loss of efficiency) and for the high pressure cooling mode could cause incomplete removal of moisture and contaminants.

SUMMARY OF THE INVENTION

An object of the present invention is to provide filter-drier apparatus which may be conveniently installed in a bi-directional flow line of a refrigeration system. Another object is to provide a dual-filter apparatus in which contaminants trapped in either filter will remain trapped upon change of the direction of refrigerant flow. Still further objects include providing a bi-directional filter-drier apparatus which is lightweight, compact and which may be easily replaced. Another object is to provide exposed piping at both ends of the unit, whereby a serviceman may simply sense the differential temperature of the piping as an indication whether the filter is blocked. A still further object is to provide a bi-directional filter-drier apparatus having the lowest possible pressure drop, for greatest efficiency.

Briefly summarizing, in the present invention a pair of uni-directional filter-drier units are utilized, one a filter-drier particularly adapted for filtering low pressure refrigerant, and the other a filter-drier particularly adapted for filtering high pressure refrigerant. The two uni-directional units are installed side-by-side in opposite directions, corresponding to the directions of the flow for the high pressure and the low pressure refrigerant. Superficially they appear to be connected in parallel; to restrict the direction of flow through each unit, corresponding to the high pressure or low pressure phase for which it was designed, a pair of check valves are provided for each unit, one at its outlet and one at its inlet. The elements are joined at their ends through the check valves by Y-connectors whose trunks are connected into the refrigerant line; flow will proceed only through the low pressure filter when in the heating mode and only through the high pressure filter when in the cooling mode.

It would first appear that this result could be achieved with a single check valve located at the outlet side of each filter unit. Such a check valve would, of course, prevent flow of refrigerant into the outlet end of the unwanted filter. However, flow out of the outlet end of that filter through which flow is then progressing, tends to draw back contaminants from the filter through which there is no flow. In the present invention, a second check valve for each filter, located at its inlet, prevents contaminants from being sucked rearward out from the filter inlet when the system changes modes.

The smooth Y-connections serve to minimize the pressure drop through the filter. In inspecting the heat pump system in which the present invention is included, a serviceman may grasp the leg of the Y-connections on opposite sides of a filter to determine the relative temperatures of the refrigerant before and after passing through the filter. A large temperature differential through the filter indicates a large pressure differential, a sign that the filter may be clogged.

Since the present invention is bi-directional, it need not be installed in the heat pump cabinet in the refrigerant line between the compressor and four-way valve, but may be installed at any convenient position in the bi-directional refrigerant line outside the cabinet, such as in the liquid line. Installation is thereby simplified, assuring that servicemen will not fail to replace the filter as required after compressor burn-outs.

DESCRIPTION OF THE PREFERRED EMBODIMENT

Figure 1:
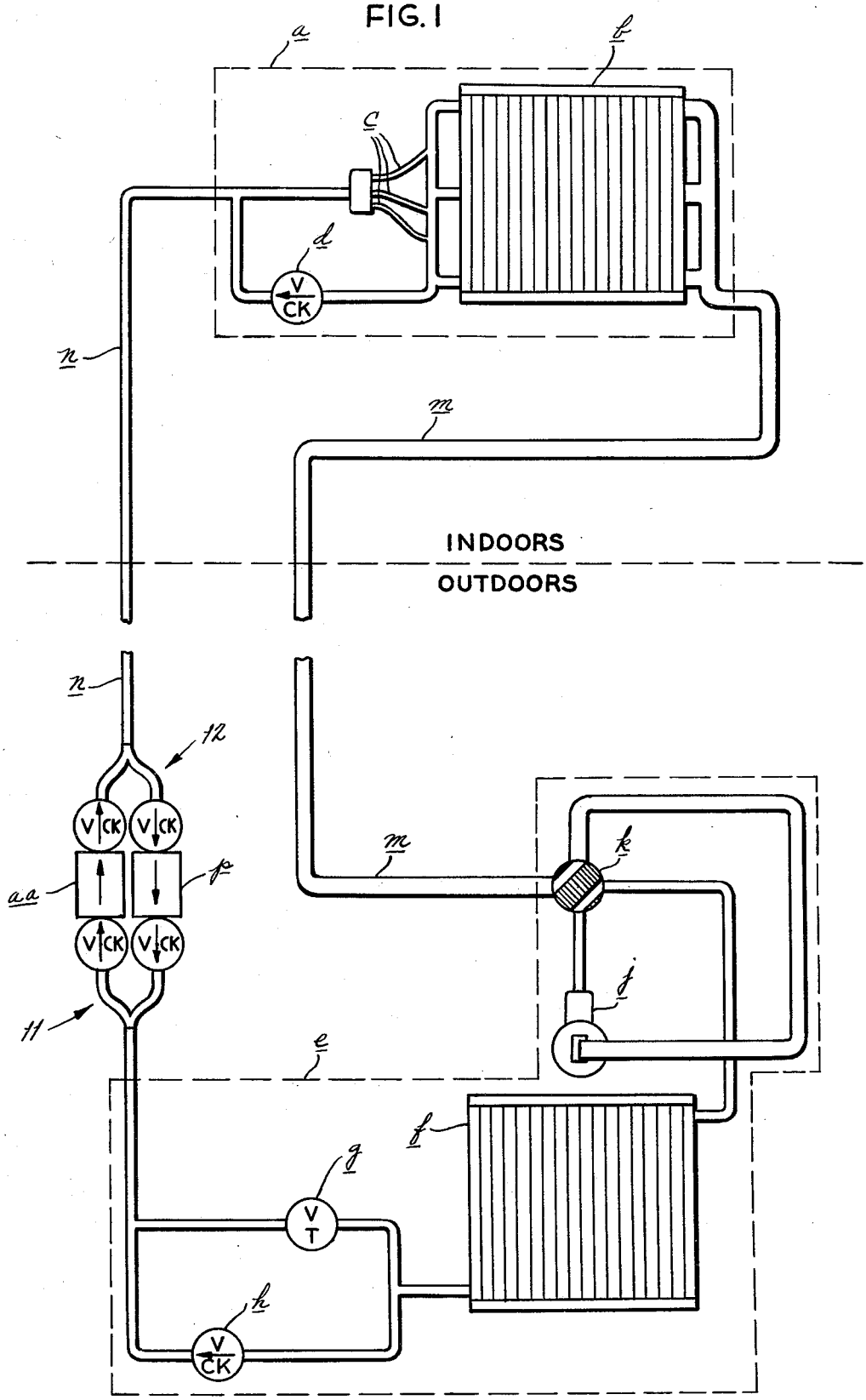
FIG. 1 is a partially schematic drawing of a typical heat pump system showing the present invention installed in the liquid line of the heat pump system.
Figure 2:
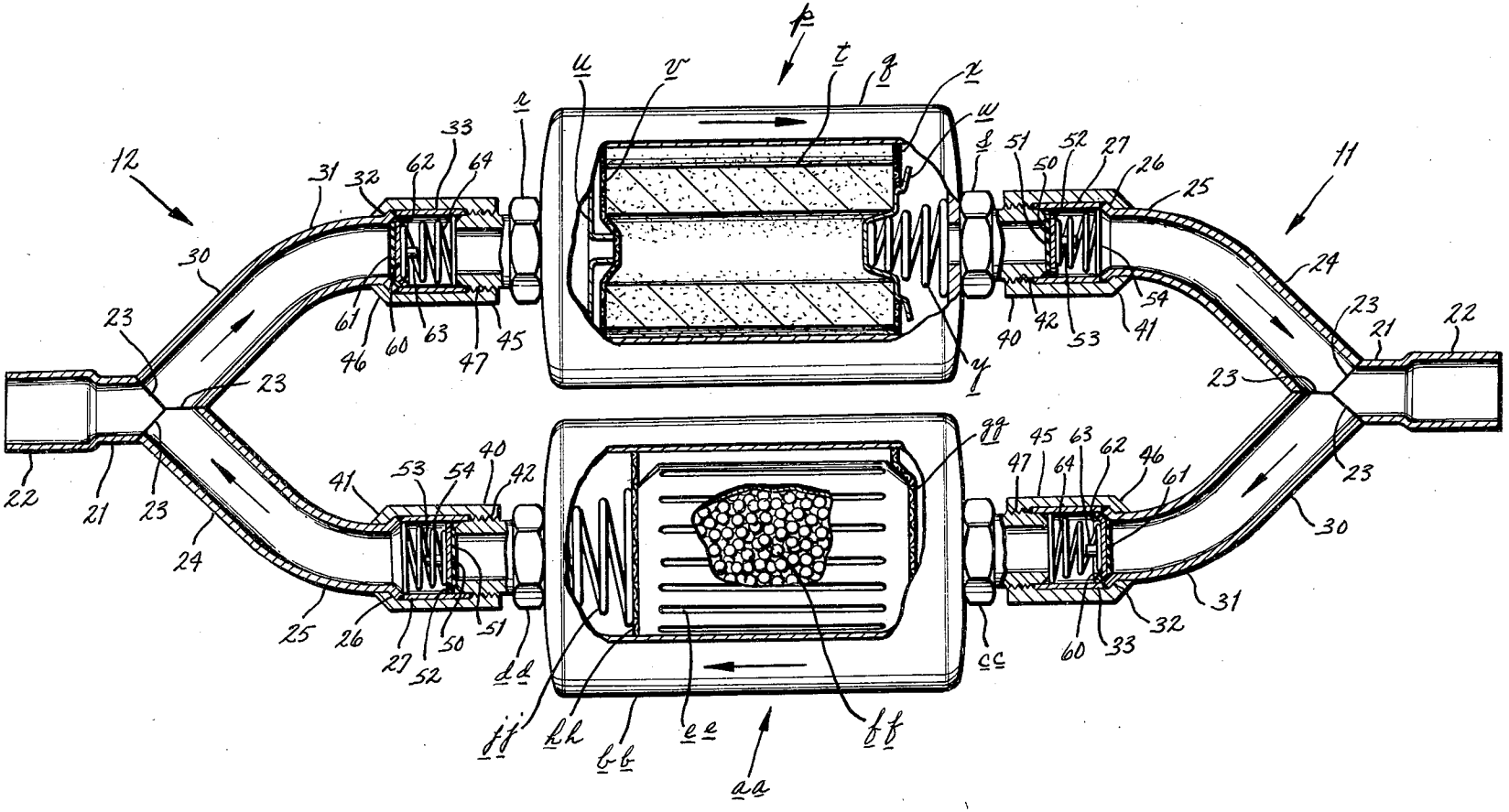
FIG. 2 is an elevational view of the bi-directional filter-drier apparatus, showing the various parts broken away to reveal their interior features.

The preferred embodiment of the bi-directional filter-drier apparatus, best seen in FIG. 2, may be installed in any conventional heat pump system. A typical heat pump system, shown in FIG. 1, will now be described in order that the use of the apparatus may be more easily understood.

A typical heat pump system is located partially indoors and partially outdoors. An indoor cabinet a, shown schematically in dashed lines in FIG. 1, primarily contains a conventional indoor coil or heat-exchanger b. Leading into the port at one end of the indoor coil b are capillary tubes c. A bypass check valve d leads from the same port, bypassing the capillary tubes c.

The outdoor portion of the typical heat pump system is contained in an outdoor cabinet e, indicated by dashed lines in FIG. 1. Contained within the outdoor cabinet e is an outdoor coil or heat exchanger f having at one of its ports a thermostatic expansion valve g bypassed by tubing containing a bypass check valve h. The outdoor cabinet e also contains a compressor j and a four-way valve k, the outlet port of the four-way valve k being connected to the inlet port of the compressor j and the outlet port of the compressor j being connected to the inlet port of the four-way valve k. The other two ports of the four-way valve k are referred to as its diversion ports. One diversion port is connected to the second port of the outdoor coil f. The second diversion port of the four-way valve k connects to a copper tube leading from the indoor coil b at its port opposite the capillary tubes c. This tube is referred to as the suction or large line m, being in the range of ⅝" to 1½" O.D. A small copper tube, herein ⅜" O.D. and here called the liquid or small line n, connects the junction of the capillary tubes c and bypass check valve d of the indoor cabinet a to the junction of the thermostatic expansion valve g and bypass check valve h of the outdoor coil f. Both the suction line m and liquid line n are reversible flow refrigerant lines.

For summer operation of the system, refrigerant flow proceeds through the liquid line n from the outdoor coil, which is serving as a condenser; to the indoor coil, which is serving as an evaporator. On a typical 90° F. summer day, for a 70° F. indoor temperature, the refrigerant in the liquid line n is at a high pressure of approximately 250 psi and in its liquid phase. For winter operation in the heating mode, for a 70° F. indoor temperature and a 0° F. outdoor temperature, the pressure in the liquid line n is low, approximately 120 psi.

The present invention is installed in the liquid line n. It utilizes two filter-driers. One is a conventional low pressure filter-drier, generally designated p, particularly adapted for filtering moisture and contaminants from refrigerant at low pressure. It has a hollow metal case q of a cylindrical cartridge shape; one end has an inlet r having male flare threads, while the other end has a similar outlet s having male flare threads. The hollow case q contains a porous cylindrical hollow-core molded granular desiccant block t, which is supported at the inlet end of the case q by an inlet block support u. An inlet screen filter v is sandwiched between the inlet block support u and the molded block t. The outlet end of the molded block t is supported by an outlet block support w, which also serves to hold in place an outlet screen filter x. To resist expansion of the granular desiccant block t as it absorbs moisture, a compression spring y is provided between the outlet block support w and the inside of the metal case q. Flow through the filter p is into its inlet r, through the inlet screen filter v into the hollow core of the molded desiccant block t, through the molded block t through the outlet screen x, and out the outlet s.

The other filter-drier used is a high pressure filter-drier, generally designated aa, having a metal case bb, similar to the metal case q of the low pressure filter-drier p with a similar inlet cc having male flare threads and outlet dd having male flare threads. Contained within the hollow case bb is a hollow fluted ceramic core ee in which is contained tightly packed molecular sieve beads ff, for absorbing moisture and acids. At the inlet end of the case bb the core ee is supported by an inlet retaining screen gg, while at the outlet end of the case bb the ceramic core ee is supported by an outlet retaining screen hh. A spring jj is provided between the outlet retaining screen hh and the outlet end of the case bb, whereby when the beads ff absorb moisture and expand, the spring jj compresses. The high pressure filter-drier aa is particularly adapted for filtering moisture and contaminants from refrigerant at high pressure.

The above-described low pressure and high pressure filter-driers are meant only as examples of the form such devices may take. Conventional filter-driers especially adapted for low pressure or high pressure use certainly may be substituted.

In the preferred embodiment of the present invention, a first Y-connector, generally designated 11, fabricated of copper tubing and best seen in FIG. 2, connects the outlet s of the low pressure filter-drier p and the inlet cc of the high pressure filter-drier aa into the liquid refrigerant line n of the conventional heat pump system. The first Y-connector 11 has a straight tubular trunk portion 21, having at one end an enlarged diameter solder or braze fitting 22, its other end being double-mitered to form a 120° included angle. At a fluid-tight juncture 23, the straight trunk portion 21 branches into a first tubular leg portion 24 and a second tubular leg portion 30 of the same diameter and correspondingly double-mitered. The first tubular leg portion 24 extends curvingly from the juncture 23 to a leg tip part 25, which has a flaring portion 26 extending into an enlarged diameter straight portion 27 at its end. The second tubular leg portion 30 is symmetrical; it has a leg tip part 31 having a flaring portion 32 leading to an enlarged diameter straight portion 33 parallel to the enlarged diameter straight portion 27 of the first leg portion 24. Both leg portions 24, 30 are, in the preferred embodiment, large enough, measured from the juncture 23 to their tip parts 25, 31, to permit manual grasping.

A first clamping nut 40 is provided radially outward of and adjacent to the leg tip part 25 of the first leg portion 24, having at one of its ends a tapered inner shoulder 41 which extends inward adjacent to the outer side of the flaring portion 26. At its opposite end it has an inwardly threaded portion 42 whose threads engage the externally theaded outlet s of the low pressure filter-drier p, connecting the leg tip part 25 to the outlet s. A second clamping nut 45 identical to the first clamping nut 40 is provided, having its tapered inner shoulder 46 outwardly adjacent to the flaring portion 32 of the second leg portion 30 and the threads of its inwardly threaded portion 47 engaging the externally threaded inlet cc of the liquid line filter-drier aa, to connect the leg tip part 31 to the inlet cc.

Contained within the leg tip part 25 of the first leg portion 24 are parts which comprise an integral check valve; these include a first disc-shaped valve plate 50, having a radially inward rubber seat 51 which normally abuts the threaded end of the outlet s of the low pressure filter-drier p when the check valve is closed. Radially outward of the rubber seat 51, the valve plate 50 has passages 52 therethrough. On the side opposite the rubber seat 52, the valve plate 50 has a perpendicular extending centering pin 53. A tapered valve spring 54, its smaller end engaged about the pin 53 and its larger end engaged against the inner side of the flaring portion 26 of the first leg 24, presses the valve plate 50 toward the outlet s.

An integral check valve is also contained within the leg tip 31 of the second leg portion 30, including a second disc-shaped valve plate 60 which has a rubber seat 61 of sufficient diameter to seal the valve plate 60 against the inner side of the flaring portion 32 of the second leg portion 30. Radially outward of the rubber seat 61, the valve plate 60 has passages 62 therethrough. The side of the valve plate 60 opposite the rubber seat 61 has a perpendicular extending centering pin 63 about which is mounted the small end of a tapered valve spring 64. The enlarged end of the valve spring 64 is engaged against the outermost point of the inlet cc of the high pressure filter-drier aa, pressing the valve plate 60 toward the inner surface of the flaring portion 32 of the second leg 30.

The bi-directional filter-drier apparatus 10 is completed by the provision of a second Y-connector 12, in all respects identical to the first Y-connector 11, as shown in FIG. 2 and numbered identically. The second Y-connector 12 is utilized to connect the inlet r of the low pressure filter-drier p and the outlet dd of the high pressure filter-drier aa into the liquid line n of the heat pump system. The inlet r of the low pressure filter-drier p is connected to the second tubular leg portion 30 of the second Y-connector 12 by the first clamping nut 40. Thus, the integral check valves of the outlet s and the inlet r of the low pressure filter-drier p permit flow only in one direction, designated by the arrow on the metal case q of the low pressure filter-drier p, shown in FIG. 2.

The outlet dd of the high pressure filter-drier aa is connected to the first tubular leg portion 24 of the second Y-connector 12 by its first clamping nut 40. Thus, the integral check valves at the inlet cc and outlet dd of the high pressure filter-drier aa permit flow only in one direction, indicated by the arrow on the metal case bb of the high pressure filter-drier aa, as shown in FIG. 2.

In constructing the first and second Y-connectors 11, 12, the fluid-tight juncture 23 may be formed by double-mitering the ends of the trunk and leg portions 21, 24, 30 as shown and then brazing together. After the clamping nuts 40, 45 have been placed upon the leg portions 24, 30, the flaring portions 26, 32 and enlarged diameter straight portions may be formed, as by swaging. The furthermost points of the leg tip parts 25, 31 are brought into position to abut the filter casing inlets r, cc and outlets s, dd; and when the clamping nuts 40, 45 are secured, the leg tip parts 25, 31 provide a defined space in which the valve plates 50, 60 may move to an open position against the bias of the valve springs 54, 64.

An assembly so made, as shown in FIG. 2, is simple to handle, install and replace. In handling by the trunk portions 21, the forked Y-construction at both ends affords balance, strength and rigidity. The filter-driers p, aa, may be separately removed for replacement, giving access to the check valve members within the leg tip parts 25, 31.

Because of the symmetry of the FIG. 2 apparatus, care must be paid to install it aligned in the correct direction in the liquid line n, in which the trunk portion 21 of the Y-connectors 11, 12 are soldered or brazed.

The apparatus 10 is so directionally installed that for the cooling mode the refrigerant flow is from the outdoor coil f through the high pressure filter-drier aa and to the indoor cabinet a; this is accomplished by connecting the trunk portion 21 of the first Y-connector 11 to the liquid line n nearest the outdoor coil f.

In the cooling mode, the liquid refrigerant flowing from the outdoor coil f through the liquid line n can flow only through the high pressure filter-drier aa; the check valve at the outlet s of the low pressure filter-drier p blocks off flow into the outlet s.

Upon a change from the cooling mode to the heating mode, either due to changing weather or for the heat pump defrost cycle, the refrigerant flow through the liquid line n, as well as the suction line m, is reversed by the four-way valve k. When this change occurs, flow through the bi-directional filter-drier apparatus 10 is no longer through the high pressure filter-drier aa, but is now from the indoor coil b through the low pressure filter-drier p to the outdoor coil f. The integral check valve at the outlet dd of the high pressure filter-drier aa prevents flow into its outlet dd.

The check valve at the inlet cc of the high pressure filter-drier aa serves a new and different purpose; it prevents the movement of the refrigerant through the low pressure filter-drier p from sucking and entraining refrigerant backward out of the high pressure filter-drier aa. Such an entrainment of refrigerant rearward would cause contaminants which were previously trapped in the filter aa to be again free to move throughout the heat pump system, causing corrosion, sludging and clogging. Eliminating such an entrainment is one of the principal advantages of the present invention.

Upon a change from the heating mode to the cooling mode, a similar problem may exist, of entraining contaminants previously trapped in the low pressure filter-drier p. Again, the problem is eliminated by use of the check valve at the inlet r of the low pressure filter-drier p. Once contaminants are trapped within the filter-driers p, aa they will not be drawn therefrom upon a change of mode of the system.

A substantial temperature differential between the inlet and outlet of a filter-drier may be sensed by manually grasping the tubing leading to the inlet and outlet; this reflects the refrigerant pressure drop through the filter. A high temperature differential reflects a high pressure drop, which signifies that the filter is clogged. The present bi-directional filter apparatus 10 facilitates such a temperature check by a serviceman. This service procedure is particularly valuable to sense clogging of high pressure filter-driers.

Use of the Y-connectors 11, 12 minimizes the pressure drop through the bi-directional filter-drier apparatus 10. The smooth Y-connectors are believed to be the most efficient structure for providing alternate flow paths. The simple side-by-side construction of the present invention provides for both compactness and light weight. The apparatus 10 is, in its width, only as wide as a conventional filter-drier. No heavy support structure is utilized; the Y-connectors 11, 12 provide all necessary support for the filters.

A single Y-connector with its two check valves installed in opposite senses is a separate inventive product; because the two Y-connectors are interchangeable, servicemen may readily maintain such Y-connectors with check valves in stock. Instead of soldering the new filters inside the heat pump cabinet, the Y-connectors can be installed outside the cabinet in a reversible flow refrigerant line along with a pair of filter-driers. Once so installed, a serviceman needs to replace only the filter-driers when they become clogged or contaminated.

Modifications will be apparent to persons skilled in the art. For example, a second similar apparatus, consisting of two filters with check valves at both ends and supported by branched connectors, might be installed into the suction line m of the heat pump system. In such embodiment, both filter-driers preferably would be low pressure filter-driers, since the suction line m always contains low pressure gaseous refrigerant.

As another variation, other connector means could be utilized to connect the inlet of one filter-drier and the outlet of the other filter-drier together and into the reversible flow refrigerant line, such as a T-connector at the inlet of one filter-drier connected by tubing to an elbow at the outlet of the other filter-drier. Preferably, the elbow would connect to the high pressure filter-drier; thereby the tubing from the elbow to the T-connector would be of sufficient length to permit manual grasping, and would enable the serviceman to make a temperature check for the high pressure filter-drier.

The integral check valves shown in the preferred embodiment are by way of example. Other types of check valves, such as non-integral check valves including ball-types and swing-types, may be interposed at the outlet and inlet of each filter-drier. These and other modifications of structure and installation will from this disclosure suggest themselves.

We claim:

1. For use in filtering moisture and contaminants from the refrigerant flowing in the refrigerant lines of a heat pump system having a reversible flow refrigerant line which, for the cooling mode of the heat pump system, contains high pressure refrigerant flowing in one direction, and which, for the heating mode of the heat pump system, contains low pressure refrigerant flowing in the opposite direction, bi-directional filter-drier apparatus comprising a first Y-connector having a straight tubular trunk portion, and two tubular leg portions joining said trunk portion at a juncture and extending to leg tip parts parallel to each other, a second Y-connector identical to said first Y-connector, the tubular trunk portions of said Y-connectors being connected in such reversible flow refrigerant line, a first filter-drier of a type especially adapted to filter high pressure refrigerant, and having an inlet at one of its ends and an outlet at its opposite end, a second filter-drier of a type especially adapted to filter low pressure refrigerant, and having an inlet at one of its ends and an outlet at its opposite end, said first Y-connector having one of its said leg tip parts connected to said inlet of said first filter-drier and the other of its said leg tip parts connected to said outlet of said second filter-drier, said second Y-connector having one of its said leg tip parts connected to said outlet of said first filter-drier and the other of its said leg tip parts connected to said inlet of said second filter-drier, a check valve interposed at the outlet of each of said first and second filter-driers, whereby to prevent refrigerant flow into said outlet on reversal of direction of flow in said refrigerant line, and a check valve interposed at the inlet of each of said first and second filter-driers, whereby on reversal of such flow to prevent entrainment into the reverse flow, of contaminants previously trapped in the filter-drier.

2. The bi-directional filter-drier apparatus as defined in claim 1, wherein the length of each said tubular leg portion of each said first and second Y-connector from its said juncture to its said leg tip part is sufficient to permit manual grasping, whereby, on grasping said leg portions at the inlet and outlet of one of said filters, to sense whether such a temperature differential exists as to reflect clogging of the filter.

3. For use in filtering moisture and contaminants from the refrigerant flowing in the refrigerant lines of a heat pump system having a reversible flow refrigerant line which, for the cooling mode of the heat pump system, contains high pressure refrigerant flowing in one direction, and which, for the heating mode of the heat pump system, contains low pressure refrigerant flowing in the opposite direction, bi-directional filter-drier apparatus comprising a first filter-drier of a type especially adapted to filter high pressure refrigerant, and having an outlet and an inlet, a second filter-drier of a type especially adapted to filter low pressure refrigerant, and having an outlet and an inlet, first connector means to connect said inlet of said first filter-drier and said outlet of said second filter-drier together and into such reversible flow refrigerant line, second connector means to connect said outlet of said first filter-drier and said inlet of said second filter-drier together and into such reversible flow refrigerant line, a check valve interposed at the outlet of each said first and second filter-driers, whereby to prevent refrigerant flow into said outlet on reversal of direction of flow in said refrigerant line, and a check valve interposed at the inlet of each of said first and second filter-driers, whereby, on such reversal of flow, to prevent entrainment, into the reverse flow, of contaminants previously trapped in the filter-drier.

4. The bi-directional filter-drier as defined in claim 3, the connector means at the inlet and outlet of at least one of said filter-driers being of a length sufficient to permit manual grasping, whereby upon such manual grasping, to sense the temperature differential of the refrigerant through a said filter-drier, indicative of clogging of the filter-drier.

5. Apparatus for use in adapting a pair of filter-driers, each having an inlet at one of its ends and an outlet at its opposite end, for filtering moisture and contaminants from the refrigerant flowing in the refrigerant lines of a heat pump system having a reversible flow refrigerant line, comprising first and second Y-connectors, each having a straight tubular trunk portion, whereby to connect said Y-connector into such refrigerant line, and first and second tubular leg portions, both joined to said trunk portion at a juncture and extending to parallel leg tip parts, first check valve means in said first leg portion to prevent refrigerant flow into its said leg tip part, and second check valve means in said second leg portion to prevent refrigerant flow outward from its said leg tip part, whereby when one of such pair of filter-driers has its inlet connected to said first leg portion of said first Y-connector and its outlet to said second leg portion of said second Y-connector, and the other of such filter-driers has its inlet connected to said first leg portion of said second Y-connector and its outlet to said second leg portion of said first Y-connector, to permit refrigerant flow through one such filter and to prevent entrainment, at its inlet, of contaminants previously trapped in the other such filter-drier.

6. The apparatus as defined in claim 6, wherein said first and second tubular leg portions of said first and second Y-connectors each are of sufficient length from said juncture to said tip part to permit manual grasping thereof, whereby upon such manual grasping, to sense the temperature differential of the refrigerant through a said filter-drier indicative of clogging of the filter-drier.

7. Apparatus for use in mounting a pair of filter-driers, each having an inlet at one of its ends and an outlet at its opposite end, for filtering moisture and contaminants from the refrigerant flowing in the refrigerant lines of a heat pump system having a reversible flow refrigerant line, comprising a pair of Y-connectors, each having a straight tubular trunk portion having at one of its ends means to connect said Y-connector into such refrigerant line, its opposite end being double-mitered to form a 120° included angle, said Y-connector further having first and second tubular leg portions, each of the same diameter as said trunk portion and having a correspondingly double-mitered end joined to the said double-mitered end of said straight tubular trunk portion at a fluid-tight juncture, each of said leg parts extending curvingly to leg tip parts parallel to each other, whereby to mount and support such pair of filter-driers in compact side-by-side relationship with minimized pressure drop for reversible flow of fluid refrigerant therethrough.

8. The apparatus as defined in claim 7, each of said Y-connectors having check valve means at the tip part of one of its said leg portions to prevent regrigerant flow into same, and check valve means at the tip part of the other of its said leg portions to prevent refrigerant flow out of same.

* * * * *

UNITED STATES PATENT AND TRADEMARK OFFICE

CERTIFICATE OF CORRECTION

PATENT NO. : 4,180,988

DATED : Jan. 1, 1980

INVENTOR(S) : Jimmy L. Forte and Creo B. Lindsay

It is certified that error appears in the above-identified patent and that said Letters Patent are hereby corrected as shown below:

In Claim 6, line 27, after "claim", delete "6" and insert ---5--- in its place.

Signed and Sealed this

*Twenty-ninth* Day of *April 1980*

[SEAL]

*Attest:*

SIDNEY A. DIAMOND

*Attesting Officer*

*Commissioner of Patents and Trademarks*